US010913520B2

(12) United States Patent
Van Der Stoel et al.

(10) Patent No.: US 10,913,520 B2
(45) Date of Patent: Feb. 9, 2021

(54) DRY DOCK FOR BUILDING AND/OR DISMANTLING NAVEL STRUCTURES

(71) Applicant: GREENDOCK PROJECT DEVELOPMENT B.V., AJ Slochteren (NL)

(72) Inventors: Jan Marius Van Der Stoel, AJ Slochteren (NL); Doekle Siebren Mulder, Sattahip Chonburi (TH)

(73) Assignee: GREENDOCK PROJECT DEVELOPMENT B.V., AJ Slochteren (NL)

( * ) Notice: Subject to any disclaimer, the term of this patent is extended or adjusted under 35 U.S.C. 154(b) by 0 days.

(21) Appl. No.: 16/072,903

(22) PCT Filed: Jan. 26, 2017

(86) PCT No.: PCT/NL2017/050050
§ 371 (c)(1),
(2) Date: Jul. 26, 2018

(87) PCT Pub. No.: WO2017/131518
PCT Pub. Date: Aug. 3, 2017

(65) Prior Publication Data

US 2019/0002066 A1 Jan. 3, 2019

(30) Foreign Application Priority Data

Jan. 27, 2016 (NL) ..... 2016167

(51) Int. Cl.
*B09C 1/08* (2006.01)
*B63C 1/08* (2006.01)

(52) U.S. Cl.
CPC ..... *B63C 1/08* (2013.01)

(58) Field of Classification Search
CPC ..... B63C 1/08
USPC ..... 405/4, 5, 11
See application file for complete search history.

(56) References Cited

U.S. PATENT DOCUMENTS

| | | | | |
|---|---|---|---|---|
| 136,560 A * | 3/1873 | Thompson et al. | B63B 9/00 | 405/5 |
| 471,805 A * | 3/1892 | Simpson | B63B 9/00 | 405/4 |
| 472,566 A * | 4/1892 | Nerta | B63B 9/00 | 405/6 |
| 561,458 A * | 6/1896 | Walsh | B63B 9/00 | 405/5 |
| 2,338,110 A | 1/1944 | Harris | | |
| 3,252,155 A * | 5/1966 | Surtees | G01M 3/40 | 427/8 |
| 3,377,810 A * | 4/1968 | Crumley | E02B 7/50 | 405/6 |

(Continued)

FOREIGN PATENT DOCUMENTS

GB 2313345 11/1997

*Primary Examiner* — Benjamin F Fiorello
(74) *Attorney, Agent, or Firm* — Mark M. Friedman

(57) ABSTRACT

A dry dock for building and/or dismantling a naval structure includes a substantially horizontal floor located below a predetermined top level, dock side walls extending from the floor to the top level, and a closable access provided in a side wall for moving a naval structure into the dry dock. At least two of the side walls are partly slanted and include a water-impervious layer. The invention also provides a method for constructing the dry dock.

21 Claims, 2 Drawing Sheets

(56) References Cited

U.S. PATENT DOCUMENTS 4,662,780 A * 5/1987 Thorsnes ..... E02B 17/025
405/1
2014/0341651 A1* 11/2014 Van Reijen ..... E01C 13/02
405/36

* cited by examiner

DRY DOCK FOR BUILDING AND/OR DISMANTLING NAVEL STRUCTURES

The invention relates to a dry dock for building and/or dismantling a naval structure, including a substantially horizontal floor that is located below a predetermined top level, dock side walls extending from the floor to the top level, a closable access being provided in a said side wall for moving a naval structure into the dock.

The invention generally relates to a dry dock for building and/or dismantling a naval structure, for example a vessel. The known dock is usually based at the sea-side, and has a dock entrance (gate) for allowing a naval structure to enter the dock. After the naval structure has entered the dock, the entrance can be closed, and sea water can be pumped out of the dock. Then, the naval structure can be dismantled piece by piece, usually by cutting the structure into sections.

The known dock includes a concrete bottom, and relatively high (>6 meter height) upwardly extending side walls. The dock is dimensioned to receive very large vessels, such as Panamax-sized vessels. A disadvantage of the known dock is that the building of the dock requires large amounts of relatively expensive construction materials, particularly steel. This makes the dockexpensive.

The present invention aims to provide an improved dry dock, wherein the above-mentioned disadvantages have been overcome or at least alleviated.

To this aim, there is provided a dry dock for building and/or dismantling a naval structure, including a substantially horizontal floor that is located below a predetermined top level, dock side walls extending from the floor to the top level, a closable access being provided in a said side wall for moving a naval structure into the dock, the dry dock being characterised in that at least two of the side walls are at least partly or entirely slanted, having:

- a gentle slope; and
- a water-impervious layer, particularly a ground water barrier layer.

It has been found that in this way, the dry dock can be provided in a relatively economical manner. Particularly, the relatively extensive side walls of the dry dock can be built in a substantially slanted manner, instead of building vertical side walls, wherein the dock's interior can still be shielded from ambient ground water using water-impervious layers (as part of the slanted side walls). Moreover, it has been found that a said water-impervious layer can be constructed in a durable, reliable manner using relatively cheap building materials.

In a further embodiment, each said water-impervious layer of a respective side wall may substantially extend along a respective gentle slope.

More particularly, the dock is provided with a water-impervious structure that extends uninterruptedly over the entire area of the dry dock (along both longitudinal and lateral dock directions), in said side walls and through or below the substantially horizontal floor. The water-impervious structure includes said at least one water-impervious layer. Optionally, said water-impervious structure can include the substantially horizontal floor, in case that floor as such is a water-impervious floor (e.g. a concrete floor). In the latter case, it is preferred that the at least one water-impervious layer is continuously connected to the floor in a water-tight manner. Also, said water-impervious structure may include an optional water-tight (e.g. concrete) floor running that may be provided on one of the slanted side walls to provide a local gently sloped ramp, e.g. for trucks, vehicles and/or other carriers to enter and exit the dock.

An example of a material that is found to be very suitable to provide the water-impervious layer is a water impervious (flexible) foil, for example a foil consisting of one layer of a water impervious plastic, or more plastic layers (a laminate foil). A said plastic can be or include, for example, a polypropylene (PP), polyethylene (PE), or a different plastic. The foil can he handled swiftly and easily during the construction of the respective side wall, over the entire length of the wall. For example, the foil can be provided in a rolled-up manner, to be rolled out over a foil receiving surface during dock construction to form the water impervious layer. Preferably, the foil (or other type of flexible water-impervious layer) has been laid with local folds or in a wave-like pattern or shape, to allow local layer movements/setting/resetting.

The foil can for example be a membrane-type of foil. The foil as such can be relatively thin (and lightweight), for example having a thickness in the range of 0.1 mm to 1 mm or another thickness. The foil may an uniform foil thickness. A said water impervious may e.g. be made of a plurality of sheets or strips of foil, being sealed to each other in a water-tight manner.

The water-impervious layer can also be formed in a different manner, using one or more different material. As an example, a said water-impervious layer can be provided by a water-impervious geotextile layer, or by a bitumen layer.

According to a further embodiment, at least two opposite longitudinal dock side walls include the gentle slope and a respective water-impervious layer. Besides, advantageously, a back side can include a gentle slope, and preferably also a concrete top layer (floor) providing dock access and exit via that top layer from/to an on-shore location.

According to a further embodiment, preferably, a slanted upper surface of each at least partly slanted side wall includes an angle with a horizontal plane that is smaller than about 45 degrees, particularly smaller than about 30 degrees. It is particularly expected that good results are obtained in case a slanted upper surface of one or more of the at least partly slanted side walls includes a relatively small angle with a horizontal plane, the relatively small angle being is smaller than about 20 degrees, and particularly an angle that is larger than 10 degrees, for example an angle in the range of 15 to 20 degrees. Additionally, a slanted upper surface of one of the at least partly slanted side walls can includes a relatively small angle with a horizontal that is in the range of about 1 to 10 degrees, particularly the surface of a lateral back wall providing a dock access/exit.

Also, an aspect of the invention provides a method as defined in claim 20.

The method for constructing a dry dock, for example a dock according to the invention, includes in arbitrary order:

- providing a substantially horizontal floor;
- providing dock side walls;
- providing a closable access in a said side wall, wherein at least two of the side walls are constructed to have a gently sloped side along a dock's vessel receiving area, and are provided with a water-impervious layer.

In this way, the above-mentioned advantages have been achieved.

The method may include: connecting the at least one water-impervious layer of said side wall in a water-tight manner to the substantially horizontal floor. Also, preferably, the method includes: the at least one water-impervious layer of said side wall in a water-tight manner to a dock structure that contains or defines the closable access (e.g. a dock gate structure).

In a further embodiment, the method includes: excavating a dock receiving cavity, and optionally providing at least one base layer in the cavity;

providing the at least one water-impervious layer of the side walls along at least a side wall part of a bottom of the cavity or the respective optional base layer; and constructing remaining parts the side walls above the respective water-impervious layer.

According to a further embodiment, the method can also include:

providing at least a bottom section of the water-impervious layer along at least a bottom part of the bottom of the cavity or the respective optional base layer; and constructing the substantially horizontal floor at a level above the bottom section of the water-impervious layer, preferably with a foundation layer between the floor and the water-impervious layer.

Most advantageously, the method includes constructing embankments to provide upper sections of the least partly slanted side walls.

In this way, a relatively shallow dock can be built, the embankments providing additional safety to the dock, e.g. against storm tides.

Advantageous further embodiments of the invention are described in the dependent claims. The invention will now be explained in more detail with reference to the drawings.

FIG. 1 schematically shows a top view of a non-limiting first embodiment of the invention;

Similar or corresponding features are denoted by similar or corresponding reference signs in this application.

Figure 1:
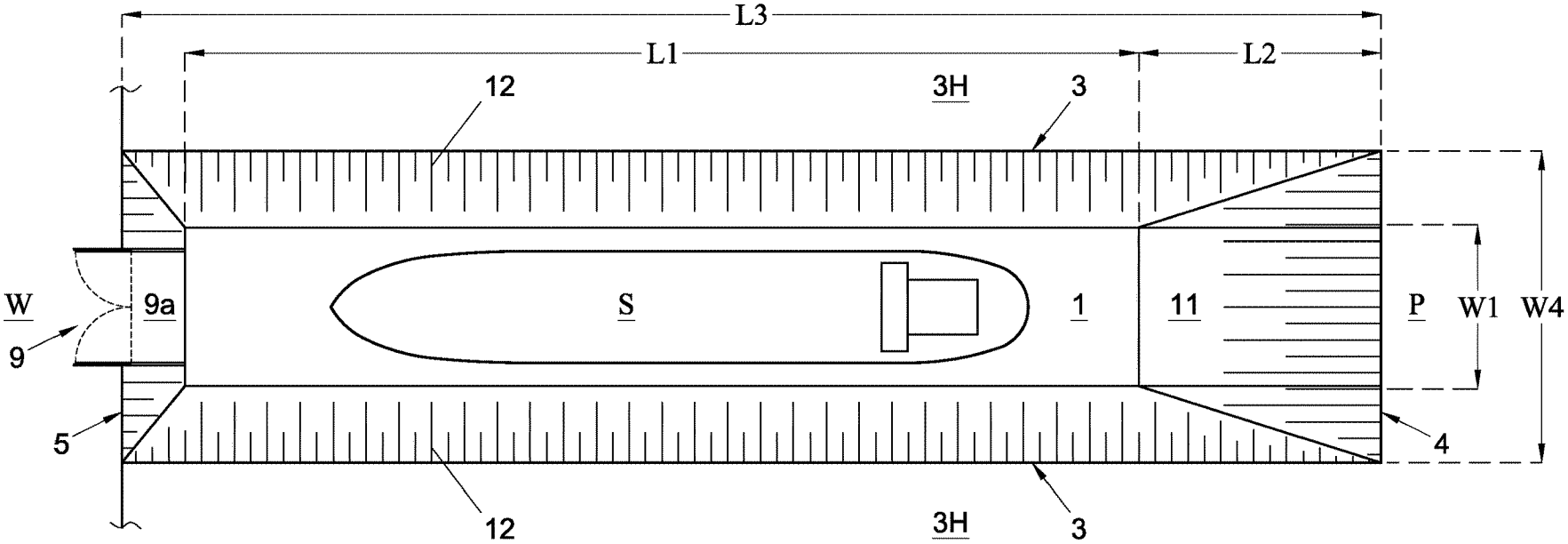
Figure 2:
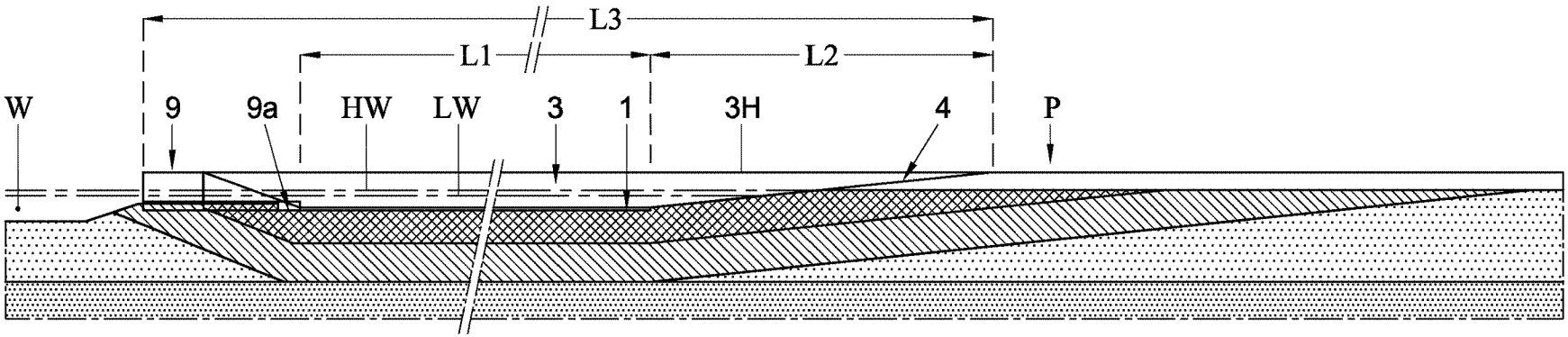
FIG. 2 shows a longitudinal vertical cross-section of the embodiment of FIG. 1.
Figure 3:
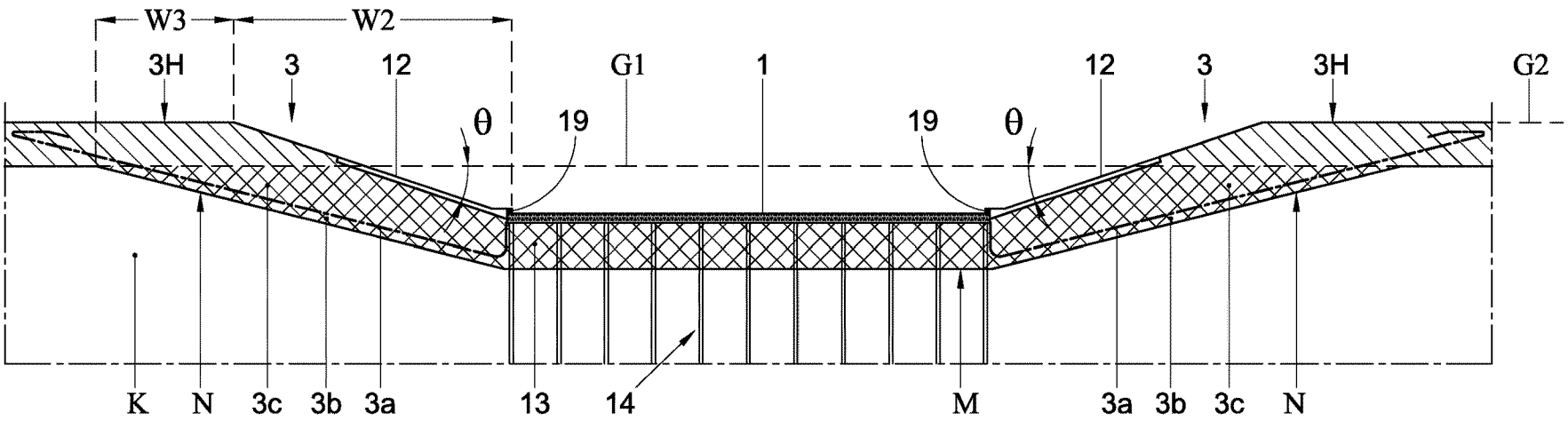
FIG. 3 shows a transversal vertical cross-section of the embodiment of FIG. 1.

FIGS. 1-3 schematically show a first embodiment of a (non-floating, stationary) dry dock (e.g. a "graving dock") for building and/or dismantling a naval structure, for example a ship S.

The dock includes a substantially horizontal floor 1 that is located below a predetermined horizontal dock top level G2 (see FIG. 3). The dock includes two opposite longitudinal side walls 3, a lateral (front) side wall 5 having a closable access 9, and a lateral (back) side wall 4, said side walls 3, 4, 5 extending from the floor to the dock's top level G2.

Said closable access 9 provides access to the dock's inner space from a water environment, for example river water or sea water, having a predetermined water level. In this example, the opposite lateral side wall 4 provides access to the dock's interior from a respective on-shore location P that is above the predetermined water level.

The closable access 9 can be configured in various ways, including e.g. a concrete dock gate construction having one or more movable doors for closing and opening a respective passageway, as will be appreciated by the skilled person.

In case of tidal (sea) water, the afore-mentioned predetermined water level may e.g. periodically vary between a low water level LW and a high water level HW, as is indicated in FIG. 2. The upper surface of the concrete bottom 1 is arranged on a level that is below the predetermined water level, for example several meters below a said low water level LW in case of periodic water level variation. In a preferred embodiment, the upper surface of the concrete bottom 1 is arranged on a level that is about 5 to 6 meters (e.g. about 5.5 meter) below a said high water HW, in case of periodic water level variation. As follows from FIGS. 1-2, the dock entrance/gate 9 can be provided with a local concrete floor 9*a* that protrudes upwardly with respect to top surface of the main floor 1, e.g. by a distance of about 1 to 2 meters (particularly a distance of about 1.5 meters).

The dock is designed for accommodating relatively large vessels S. To that aim, particularly, the substantially concrete floor 1 as such has a length L1 of at least about 200 meters, and preferably a length in the range of about 250 to 400 meters (for example a length L1 of about 300 meters). Also, the concrete floor 1 can have width W1 of at least about 35 meters, and preferably a width W1 in the range of about 40 to 75 meters (for example a width W2 of about 50 meters).

In this example, the dock has been partly made in an excavation (pit, dugout) that has been made on-site, in the ground K. Preferably, the main floor 1 is made of reinforced/armoured concrete (the concrete including e.g. steel reinforcement bars, grids and/or webbings). A thickness of the concrete floor can e.g. be about 0.5 meter or about 1 meter.

Figure 4:
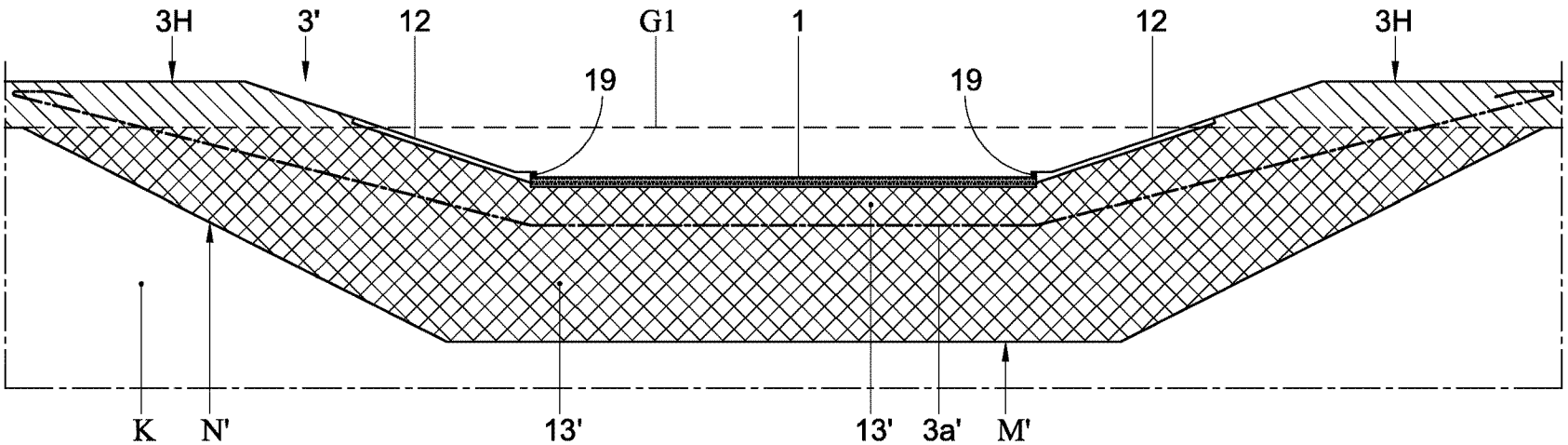
FIG. 4 is similar to FIG. 3 and shows a transversal vertical cross-section of a further embodiment.

As follows from FIGS. 2, 3, in an embodiment, the substantially horizontal floor 1 can be a concrete floor having a pile foundation 14 (e.g. existing of a grid of concrete piles extending normally—vertically—below the floor 1). Particularly, there can be provided a primary stabilisation 13 layer (or layers), for example including or consisting of sand, extending below the concrete floor 1. In a preferred embodiment, the primary stabilisation 13 layer (or layers) is/are laid in an aforementioned excavation. The foundation piles 14 extend through the at least one primary stabilisation layer, and into a lower section of the ground K, to provide a durable and stable support for the massive dock floor 1. FIG. 4, explained below, shows an alternative further advantageous example, that does not include a pile foundation.

In the present first example, advantageously, at least the two opposite longitudinal dock side walls 3 include a gentle slope (see particularly FIG. 3). It has been found that a resulting stable and durable dock can be constructed in a relatively inexpensive way, particularly because the side walls do not have to be vertical side walls anymore.

Also, in this example, the two lateral side walls 4, 5 are provided with such slanted surfaces, along respective gentle slopes (see FIG. 1, 2). Slanted surfaces in the front lateral side wall 5 e.g. extend next to the gate 9 (e.g. at opposite sides) in that wall 5, see FIG. 1.

In this highly advantageous example, a slope of the lateral back side wall 4 is significantly smaller than the slopes of the longitudinal side walls 3 (the lateral back side wall 4 for example having a maximum slope angle that is 50% of the slope angle θ of longitudinal side walls, for example a maximum slope angle of about 10 degrees, and for example a minimum slope angle of 1 degrees), allowing transport of naval structure parts into or out of the dock using transport means (e.g. rollable supporting carriers, transport vehicles, trains, trucks or the-like).

The bottom of the lateral (slanted) back side wall 4 may be provided with a slanted concrete floor 11 for supporting heavy loads, such as carriers transporting naval structure part out or (or into) the dock. When viewed in a top view, a horizontal length L2 of the lateral back side wall 4 (measured in parallel with the dock's central line) can e.g. be in the range of about 50 to 100 meters, for example a range of 60 to 80 meters, for example about 75 meters. In the example, both longitudinal side walls 3 are fully slanted, providing upwardly facing slanted surfaces with gentle slopes. The slanted upper surface of each at least partly slanted longitudinal side wall 3 includes an angle θ with a horizontal plane that is smaller than about 45 degrees, particularly smaller than about 30 degrees. More preferably, said angle θ is smaller than about 20 degrees. Also, preferably, said angle θ is larger than 10 degrees. For example, the angle θ can be in the range of 15 to 20 degrees. In the present example, both side walls 3 are provided with the same slope, however, that is not required.

As a result of the gentle slopes, each longitudinal side wall 3 as such can be relatively wide, measured in horizontal direction. For example, a width W2 of each slanted upper side of the side wall 3, measured horizontally from a point above a longitudinal edge of the bottom 1 of the dock to a longitudinal upper inner edge of that surface (i.e. at the top level G2), can be at least 20 meters, for example about 25 meters or more (a maximum width W2 e.g. being 50 meters).

As follows from FIG. 3, the longitudinal side wall 3 may be provided with an outer wall section, that is located above an outer section of an above-mentioned excavation in this example, the outer wall section having e.g. a width W3 in the range of about 10 to 40 meters, for example 20 to 30 meters.

As has been mentioned before, at least part of the dock (e.g. at least 50%) can reside in an excavation in the ground K. In FIG. 3, an initial ground level (before the dock was constructed) is indicated by dashed line G1. A width W4 of the excavation (see e.g. FIG. 1) is significantly larger than the width W1 of the dock's bottom, for example by at least 50% and particularly by at least 90%. The width W4 of the excavation that receives a dock or dock part can e.g. be at least 50 meters, particularly at least 80 meters, for example about 100 meters. Also, a maximum width of such an excavation can be e.g. 150 meters, or another maximum width (e.g. larger than 150 meters).

A length L3 of said excavation can be the sum of the length L1 of the bottom 1 and the lengths of the two lateral side walls (measured in horizontal direction). As an example, the length L3 of said excavation can be more than 250, for example a length in the range of 300 to 500 meters (particularly a length in the range of about 450 to 450 meters, for example about 400 meters, or longer).

In the example, the excavation as such can have a substantially horizontal upper side M (see FIG. 3) extending at a distance below the dock bottom 1 (with said primary stabilisation layer there-between). Besides, in the example, the excavation as such can substantially slanted upper sides N along lower sides of the two side walls 3.

In this example, the top level G2 of the dock is located above the initial ground level G1. To that aim, the dock is provided with (partly slanted) embankments, providing respective upper parts of all side walls 3, 4, 5. Particularly, the at least partly slanted side walls 3 include embankments 311 that extend on top of an initial ground level G1, the embankments 311 preferably providing parts of the slanted inner dock sides (see FIG. 3). Similarly, the two lateral side walls 4, 5 are provided with respective (partly slanted) embankment parts.

Preferably, the slanted upper surfaces of each at least partly slanted longitudinal side wall 3 is defined by a fixation layer 12 (see FIG. 3, 4). For example, the slanted upper surface of each at least partly slanted side walls 3 can be defined by a stabile layer 12 including one or more of rocks, rocklike elements, crushed stone, or a different type of layer 12. In the present embodiments, the fixation layers 12 at least extend from the level of the bottom 1 to the slanted sides of said embankment sections 311. Longitudinal walls 19, for example made of (reinforced) concrete, may extend along the concrete bottom 1 for supporting lower longitudinal sides of said fixation layers 12. Slanted sections of the lateral walls 4, 5 may be configured in a similar manner, with respective fixation layers 12 and respective lower supporting walls.

In the present examples, the dock is provided with a water-impervious structure 3*a*, 1, 11, 3*a*' that extends uninterruptedly over the entire area of the dry dock (along both longitudinal and lateral dock directions), in said side walls and through or below the substantially horizontal floor.

Advantageously, the longitudinal side walls 3 as such contain respective water-impervious layers 3*a* (see FIG. 3), providing ground water barrier layers. In this embodiment, these layers 3*a* are part of said water-impervious structure. In a further embodiment, each said water-impervious layer 3*a* of a respective side wall substantially extends along a respective gentle slope.

The lateral side walls 4, 5 are provided with such respective water-impervious layers as well. It should be observed that the back lateral side wall 4 is preferably provided with a concrete bottom 11, which concrete bottom 11 as such can provide at least part of a respective water-impervious layer of that wall 4. Also, clearly, the front lateral side wall 5 is provided with the dock gate 9, so that a respective water-impervious layer is provided in front side wall sections that are located next to the dock gate (in the case that the dock gate does not take up all the space of that front wall 5).

In the present embodiment, the water-impervious layers 3*a* are connected to the concrete bottom 1 in a continuously water-tight manner (for example directly, or indirectly using suitable connection or intermediate sealing means), and extend through the respective side walls to a level at or close to the top level G2 of the dock. Moreover, as follows from FIG. 3, the water-impervious layers 3*a* of this embodiment, extend to a level above said initial ground level G1, and to locations in said embankment sections 311, laterally externally with respect of the excavation that contains part of the dock.

Also, a water-impervious layer (if any) of the lateral back side wall 4 can be connected to a respective concrete bottom 11 in a continuously water tight manner (for example directly, or indirectly using suitable connection or sealing means), and extend through the respective side walls to a level at or close to the top level G2 of the dock.

Also, a water-impervious layer (if any) of the lateral front side wall 5 can be connected to a respective dock gate structure in a continuously water tight manner (for example directly, or indirectly using suitable connection or sealing means), and extend through the respective side walls to a level at or close to the top level G2 of the dock.

Thus, the various water-impervious layers and the concrete main bottom 1 (and optional concrete back side bottom 11) of the dock provide a water tight barrier, preventing ground water from penetrating into the dock's interior.

In a further embodiment, the at least partly slanted side walls 3 at least include one first stabilizing layer 3*b* extending below the water-impervious layer 3*a*. In a further example, the first stabilizing layer 3*a* is or includes a sand layer. For example, this layer 3*a* can be sand layer, or a layer consisting of at least 50% sand and one or more other suitable building materials. In the example, the first stabilizing layer 3*b* extends on top of the slanted parts of the said excavation, and can provide a levelling function.

Also, the at least partly slanted side wall 3 can at least includes one second stabilizing layer 3*c* extending above the water-impervious layer 3*a*, particularly having a thickness (and respective weight) to press and hold the water-tight layer 3*a* in place, against possible pressure of ambient ground water.

For example, this layer 3*a* can be sand layer, or a layer consisting of at least 50% sand and one or more other suitable building materials. Thus, for example, the second stabilizing layer 3*c* can be made of the same material or materials as the first stabilizing layer 3*b*.

As is mentioned before, advantageously, the water-impervious layer 3*a* as such can be made of a flexible material. Preferably, the water-impervious layer 3*a* is a water impervious foil, for example a plastic foil. The impervious layers 3*a* may also be configured differently.

In case of a flexible water-impervious layer 3*a*, preferably, the layer is provided with a number of local folds or be at least partly laid in a wave-like pattern, allowing flexing and/or deformation of the layer 3*a*, e.g. due to setting and/or resetting and/or local movement or nearby layers 3*b*, 3*c*.

Preferably, the dock is provided with a means for pumping water from the dock's interior. For example, the concrete floor 1 can be provided with one or more drainage openings for draining water out of the dock. Also, one or more pumps can be provide for pumping water out of the dock.

Operation of the dock can involve dismantling a naval structure S. To that aim, the dock's entrance 9 can be opened, allowing ambient water entering the dock (in case the dock is still empty), and allowing the naval structure S to enter the dock. Preferably, this is carried out during a high water level period; in that case, once the naval structure S is inside the dock, part of the water can leave the dock via the dock's entrance 9 when the water level lowers to a respective low water level LW. Then, the dock's entrance 9 can be closed, and any remaining water can be drained from the dock. Preferably, the naval structure S is supported on the dock bottom 1 using intermediate supports. Next, the naval structure S can be dismantled, wherein naval structure parts can be removed from the dock via the gently sloped exit side (i.e. the slanted floor 11 at the back side 4). Alternatively, the dry dock can be used for construction of a naval structure S.

A major advantage of the dock, shown in FIGS. 1-3, is that it can be constructed in a relatively efficient manner, using overall relatively inexpensive building materials (for example sand). Construction can be carried out in the following manner.

First, a said excavation can be made in the ground to receive a major part of the dock (except surrounding embankment parts, if any). The excavation can have a substantially rectangular shape, with the slanted sides N and substantially horizontal central side M. The excavation can be relatively large, as follows from the above (with an above-mentioned excavation length L3 and an excavation width W4).

After the excavation can been provided, the concrete bottom 1 and side wall structures 3 can be provided. In the present first example, the concrete bottom 1 can be laid after the primary stabilisation 13 layer (or layers) has been laid, after the foundation piles 14 have been arranged into the ground and primary stabilisation 13 layer, and for example after the slanted side walls 3 (4, 5) have been partly constructed. As is mentioned before, the concrete bottom 1 is preferably provided with reinforcement, and is preferably connected to adjoining water-impervious layers 3*a* in a water-tight manner.

The side walls 3, 4, 5 are constructed as to have the gently sloped side along the dock's vessel receiving area. In this example, the side walls 3, 4, 5 can be constructed after the excavation has been provided, wherein the construction involves providing the first stabilization layers 3*b* on respective locations in the excavation (i.e. on the respective slanted bottom sections N), providing the least one water-impervious layer 3*a* (e.g.—but not limited to—a foil) over the respective first stabilization layers 3*b*, and subsequently constructing remaining parts 3*c*, 12, 311 of the side walls 3 above the respective water-impervious layer 3*a*. Particularly, in this example, the method further includes constructing the embankments 311 to provide upper sections of the least partly slanted side walls 3.

Also, further dock features, such as a closable access 9 in a said side wall 5, a concrete slanted bottom 11 in an opposite lateral side wall 4, drainage means and-the like can be provided at appropriate construction steps.

FIG. 4 shows an alternative embodiment, which differs from the embodiment depicted in FIG. 3 in that the substantially horizontal floor 1 is a concrete floor without a pile foundation. In this example, the water-impervious layer 3*a*' also extends at a level below the substantially horizontal floor 1. Preferably, a single water-impervious layer 3*a*' is provided, extending within the longitudinal side walls 3' and extending below the central bottom section 1 of the dock.

Particularly, the embodiment depicted in FIG. 4 partly lies in a large excavation, having slanted sides N' and a substantially horizontal bottom side M', wherein at least one stabilisation layer 13' (for example consisting of sand, or sand in combination with one or more other building materials) has been laid. The water-impervious layer 3*a*' extends through that stabilisation layer 13' and providing a ground water barrier for the entire dock.

Particularly, also, a stabilizing layer section 13' extending above the water-impervious layer 3*a*', preferably has a thickness (and respective weight) to press and hold the water-tight layer 3*a*' in place, countering possible pressure of ambient ground water.

In the foregoing specification, the invention has been described with reference to specific examples of embodiments of the invention. It will, however, be evident that various modifications and changes may be made therein without departing from the broader spirit and scope of the invention as set forth in the appended claims.

In the claims, any reference signs placed between parentheses shall not be construed as limiting the claim. The word 'comprising' does not exclude the presence of other features or steps then those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to advantage.

For example, the above-mentioned dock dimensions are merely exemplary embodiments of the invention. Dock lengths and widths can be larger or smaller than aforementioned dimensions, depending e.g. on the type (and dimensions) of a naval structure that is to be received in the dock.

Besides, stabilisation layers 3*b*, 3*c*, 13, 13' of the dock (particularly of the side walls 3, 4, 5 and below the central concrete floor 1) can include various materials, for example but not limited to sand. In an embodiment, one or more of the stabilisation layers 3*b*, 3*c*, 13, 13' can include or substantially consist of clay containing soil. In an embodiment, one or more of the stabilisation layers 3*b*, 3*c*, 13, 13' can include or substantially rock dump. In an embodiment, one or more of the stabilisation layers 3*b*, 3*c*, 13, 13' can include or substantially consist of crushed stone. Also, in an embodiment, one or more of the stabilisation layers 3*b*, 3*c*, 13, 13' can include or substantially consist of natural building material(s). Besides, it will be clear that one or more of the stabilisation layers 3*b*, 3*c*, 13, 13' can include or consist of a mixture of afore-mentioned materials, the materials including sand, clay containing soil, rock dump, and crushed stone. Particularly, each stabilisation layers 3*b*, 3*c*, 13, 13' is configured such that it provides a stabile supporting layer for dock structure(s) extending above that layer.

For the purpose of clarity and a concise description features are described herein as part of the same or separate embodiments, however, it will be appreciated that the scope of the invention may include embodiments having combinations of all or some of the features described". In view of this passage it is evident to the skilled reader that the variants of claim 1 as filed may be combined with other features described in the application as filed, in particular with features disclosed in the dependent claims, such claims usually relating to the most preferred embodiments of an invention.

Many variants are possible and are considered to fall within the scope of the claims as defined hereafter.

The invention claimed is:

1. A dry dock for building and/or dismantling a naval structure, comprising:

a substantially horizontal floor that is located below a predetermined top level, dock side walls extending from the floor to the top level, and a closable access provided in a said dock side wall for moving a naval structure into the dock, said closable access being in mechanical communication with said dock side wall in a continuously water-tight manner up to a level at or close to said top level, wherein each of at least two of the dock side walls is an at least partly slanted side wall, comprising a slope and a water-impervious layer which comprises a water-impervious foil and is configured to act as a ground water barrier, and comprising a first stabilizing layer extending below the water-impervious layer and a second stabilizing layer extending above the water-impervious layer.

2. The dock according to claim 1, wherein at least two opposite longitudinal dock side walls include the slope and the water-impervious layer.

3. The dock according to claim 1, wherein a slanted upper surface of the at least partly slanted side wall forms an angle (Θ) with a horizontal plane that is smaller than about 45 degrees.

4. The dock according to claim 1, wherein a slanted upper surface of the at least partly slanted side wall forms an angle (Θ) with a horizontal plane that is smaller than 20 degrees and larger than 1 degree.

5. The dock according to claim 1, wherein the first stabilizing layer is or includes a sand layer.

6. The dock according to claim 1, wherein the second stabilizing layer comprises the same material or materials as the first stabilizing layer.

7. The dock according to claim 1, wherein a slanted upper surface of the at least partly slanted side wall is defined by a fixation layer.

8. The dock according to claim 1, wherein a slanted upper surface of the at least partly slanted side wall is defined by a stabile layer comprising a material selected from the group consisting of rocks, rocklike elements, and crushed stone.

9. The dock according to claim 1, wherein the water-impervious layer comprises a flexible material.

10. The dock according to claim 1, wherein the substantially horizontal floor is a concrete floor having a pile foundation.

11. The dock according to claim 1, wherein the substantially horizontal floor is a concrete floor without a pile foundation.

12. The dock according to claim 1, wherein the substantially horizontal floor is a water-tight floor connected directly or indirectly to the water-impervious layer in a continuously water-tight manner.

13. The dock according to claim 1, wherein the water-impervious layer extends to a level below that of the substantially horizontal floor.

14. The dock according to claim 1, wherein at least part of the dock resides in an excavation in the ground, which has at least one substantially slanted upper side for defining a lower side of the at least partly slanted side wall.

15. The dock according to claim 1, wherein the top level is located above a ground level.

16. The dock according to claim 1, wherein the at least partly slanted side wall includes an embankment having a slanted inner dock side.

17. A method for constructing a dry dock comprising in no particular order the steps of:

providing a substantially horizontal floor;

providing dock side walls; and providing a closable access in a said dock side wall, said closable access being in mechanical communication with said dock side wall in a continuously water-tight manner up to a level at or close to a predetermined top level;

wherein each of at least two of the dock side walls is constructed to have an at least partly slanted side wall along a dock vessel receiving area, and said at least partly slanted side wall is provided with a water-impervious layer which comprises a water-impervious foil and is configured to act as a ground water barrier, and is provided with a first stabilizing layer extending below the water-impervious layer and a second stabilizing layer extending above the water-impervious layer.

18. The method according to claim 17, further comprising the steps of:

excavating a dock receiving cavity;

providing the water-impervious layer along at least a side wall part of a bottom of the dock receiving cavity; and constructing remaining parts of the dock side walls above the water-impervious layer.

19. The method according to claim 18, further comprising the steps of:

providing a bottom section of the water-impervious layer along at least a bottom part of the bottom of the cavity; and constructing the substantially horizontal floor at a level above the bottom section of the water-impervious layer, with a foundation layer between the floor and the water-impervious layer.

20. The method according to claim 17, further comprising the step of constructing an embankment to provide an upper section of the at least partly slanted side wall.

21. The method according to claim 17, further comprising the step of connecting the water-impervious layer in a continuously water-tight manner to adjoining dock structures.

* * * * *